US011661763B2

(12) United States Patent
Qiu

(10) Patent No.: US 11,661,763 B2
(45) Date of Patent: May 30, 2023

(54) ANTI-UNLATCHED MECHANISM AND A DOOR LOCK THEREOF

(71) Applicant: CMECH (GUANGZHOU) LTD., Guangdong (CN)

(72) Inventor: Jia Sen Qiu, Guangdong (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 190 days.

(21) Appl. No.: 17/249,314

(22) Filed: Feb. 26, 2021

(65) Prior Publication Data

US 2022/0010590 A1 Jan. 13, 2022

(30) Foreign Application Priority Data

Jul. 1, 2020 (CN) ..... 202010619727.3
Jul. 1, 2020 (CN) ..... 202010622272.3
(Continued)

(51) Int. Cl.
*E05B 13/00* (2006.01)
*E05C 9/04* (2006.01)
(Continued)

(52) U.S. Cl.
CPC ..... *E05B 13/004* (2013.01); *E05B 1/003* (2013.01); *E05B 3/003* (2013.01); *E05B 15/04* (2013.01);
(Continued)

(58) Field of Classification Search
CPC ..... Y10T 292/0843; Y10T 292/0834; Y10T 292/0836; Y10T 292/1018;
(Continued)

(56) References Cited

U.S. PATENT DOCUMENTS 2,361,734 A 10/1944 Baume
3,390,557 A 7/1968 Erickson et al.
(Continued)

FOREIGN PATENT DOCUMENTS

AU 633318 11/1990
AU 2004203232 A1 2/2005
(Continued)

*Primary Examiner* — Kristina R Fulton
*Assistant Examiner* — Steven A Tullia
(74) *Attorney, Agent, or Firm* — McKee, Voorhees & Sease, PLC

(57) ABSTRACT

An anti-unlocked mechanism comprises a transmission gear, a sliding rod, a locking member and a first elastic member. The transmission gear includes an arc surface. An end of the sliding rod contacts the deadbolt of the lock body. The sliding rod is provided with a fixed stopper and a second elastic member. When the deadbolt is retracted, the sliding rod moves with the deadbolt against the elastic force of the second elastic member. When the deadbolt extends, the locking member moves with the sliding rod to block the rotation of the rotating part. The first elastic member comprises first and second protrusions. The second protrusion will not hinder the fixed stopper of the slide rod unless the first protrusion contacts with the circular arc surface, which will block the movement of the locking member to block rotation of the rotating part.

22 Claims, 6 Drawing Sheets

(30) Foreign Application Priority Data

Jul. 1, 2020 (CN) ..... 202010622790.2
Sep. 30, 2020 (CN) ..... 202011060664.9

(51) Int. Cl.

| | |
|---|---|
| ***E05B 63/14*** | (2006.01) |
| ***E05B 63/04*** | (2006.01) |
| ***E05C 1/08*** | (2006.01) |
| ***E05B 1/00*** | (2006.01) |
| ***E05B 3/00*** | (2006.01) |
| ***E05B 15/04*** | (2006.01) |
| ***E05B 63/08*** | (2006.01) |

(52) U.S. Cl.
CPC ..... *E05B 63/044* (2013.01); *E05B 63/14* (2013.01); *E05C 1/085* (2013.01); *E05C 9/04* (2013.01); *E05B 63/08* (2013.01); *E05B 63/146* (2013.01); *E05B 2015/0406* (2013.01); *E05Y 2900/132* (2013.01)

(58) Field of Classification Search
CPC ..... Y10T 292/0993; Y10T 292/307; Y10T 70/5226; Y10T 70/523; Y10T 70/5235; Y10T 70/5239; Y10T 70/5243; Y10T 70/55; Y10T 70/5518; E05B 13/004; E05B 63/14; E05B 63/08; E05B 63/146; E05B 2015/0406; E05Y 2900/132; E05C 9/04; E05C 9/021; E05C 9/041; E05C 9/12

See application file for complete search history.

(56) References Cited

U.S. PATENT DOCUMENTS

| | | | | |
|---|---|---|---|---|
| 3,446,524 | A | 5/1969 | Barry | |
| 4,548,432 | A | 10/1985 | Bengtsson | |
| 4,893,849 | A | 1/1990 | Schlack | |
| 4,950,005 | A | 8/1990 | Cudd | |
| 5,123,684 | A | 6/1992 | Yeh | |
| 5,301,525 | A * | 4/1994 | Doring | E05B 63/0021 70/110 |
| 5,495,731 | A * | 3/1996 | Riznik | E05C 9/026 70/108 |
| 5,707,090 | A * | 1/1998 | Sedley | E05B 47/0043 292/172 |
| 6,045,169 | A | 4/2000 | Frolov | |
| 6,209,883 | B1 | 4/2001 | Kashmerick et al. | |
| 6,209,893 | B1 | 4/2001 | Ferris | |
| 6,209,931 | B1 | 4/2001 | Stoutenborough et al. | |
| 6,289,704 | B1 * | 9/2001 | Collet | E05B 63/20 70/134 |
| 6,293,598 | B1 | 9/2001 | Rusiana | |
| 6,349,982 | B2 | 2/2002 | Fayngersh et al. | |
| 6,393,878 | B1 | 5/2002 | Fayngersh et al. | |
| 6,682,109 | B2 | 1/2004 | Horne et al. | |
| 7,108,300 | B2 | 9/2006 | Hodgin et al. | |
| 8,234,892 | B2 | 8/2012 | Laverty et al. | |
| 8,366,158 | B2 | 2/2013 | Chen | |
| 8,371,627 | B2 | 2/2013 | Chiang et al. | |
| 8,474,884 | B2 | 7/2013 | Helisten et al. | |
| 8,523,247 | B2 | 9/2013 | Talpe | |
| 8,523,249 | B2 | 9/2013 | Hodgin et al. | |
| 8,540,288 | B2 * | 9/2013 | Tsai | E05C 9/026 292/64 |
| 8,550,506 | B2 | 10/2013 | Nakanishi et al. | |
| 8,702,131 | B1 | 4/2014 | Gianoli et al. | |
| 2004/0169378 | A1 | 9/2004 | Hodgin et al. | |
| 2005/0092042 | A1 | 5/2005 | Constantinou et al. | |
| 2005/0103066 | A1 | 5/2005 | Botha et al. | |
| 2007/0114800 | A1 | 5/2007 | Kuo | |
| 2008/0042452 | A1 | 2/2008 | Moon et al. | |
| 2011/0210566 | A1 | 9/2011 | Chen | |
| 2012/0000257 | A1 * | 1/2012 | Wheeler | E05B 63/0013 70/91 |
| 2017/0030112 | A1 * | 2/2017 | Kane | E05C 9/041 |
| 2022/0010594 | A1 | 1/2022 | Qiu | |

FOREIGN PATENT DOCUMENTS

| | | | | |
|---|---|---|---|---|
| AU | 2004229071 | B2 * | 7/2010 | E05B 59/00 |
| CA | 2254164 | A | 6/1999 | |
| CN | 110630113 | A * | 12/2019 | E05B 17/2092 |
| CN | 111101764 | A * | 5/2020 | E05B 3/065 |
| DE | 3605826 | A1 * | 2/1986 | E05C 9/02 |
| DE | 4014041 | A1 | 11/1991 | |
| DE | 9321445 | U1 | 2/1998 | |
| DE | 29722665 | U1 * | 3/1998 | E05B 63/0021 |
| DE | 20218956 | U1 | 2/2003 | |
| EP | 0358971 | A2 * | 8/1989 | E05C 9/042 |
| EP | 0454958 | A1 * | 2/1991 | E05B 59/00 |
| EP | 0454965 | A1 * | 2/1991 | E05C 9/047 |
| EP | 0661409 | A2 | 7/1995 | |
| EP | 1091064 | A2 * | 4/2001 | E05C 9/021 |
| EP | 1098057 | B1 | 12/2004 | |
| EP | 1857617 | A2 * | 11/2007 | E05B 17/2092 |
| EP | 1865132 | A1 * | 12/2007 | E05B 63/0004 |
| EP | 2503080 | A2 * | 9/2012 | E05B 15/0013 |
| EP | 3438384 | A1 * | 2/2019 | |
| FR | 2836505 | A1 * | 8/2003 | E05C 9/042 |
| FR | 3028547 | A1 * | 5/2016 | E05B 3/065 |
| GB | 550024 | A | 12/1942 | |
| GB | 631343 | A | 11/1949 | |
| GB | 1246441 | A | 9/1971 | |
| GB | 1462351 | A | 1/1977 | |
| GB | 2202267 | A | 9/1988 | |
| GB | 2268221 | A | 5/1994 | |
| GB | 2424035 | A | 9/2006 | |
| KR | 101876126 | B1 | 7/2018 | |
| WO | 9961734 | A2 | 12/1999 | |
| WO | 2072985 | A1 | 9/2002 | |
| WO | 2008094472 | A2 | 8/2008 | |
| WO | 2008124874 | A1 | 10/2008 | |
| WO | 2015058253 | A1 | 4/2015 | |
| WO | WO-2015058253 | A1 * | 4/2015 | E05B 13/004 |
| WO | WO-2019033147 | A1 * | 2/2019 | E05B 13/004 |

* cited by examiner

ANTI-UNLATCHED MECHANISM AND A DOOR LOCK THEREOF

PRIORITY CLAIMS AND INCORPORATION OF RELATED APPLICATIONS

This application claims priority to the following three Chinese applications, and incorporate by reference their related pending US applications in their entireties:

(A) Chinese application 202010622272.0, filed Jul. 1, 2020;

(B) Chinese application 202010619727.3, filed Jul. 1, 2020 and U.S. Ser. No. 17/249,308, filed Feb. 26, 2021, MVS Ref No. P13400US00;

(C) Chinese application 202011060664.9, filed Sep. 30, 2020, and U.S. Ser. No. 17/249,326, filed Feb. 26, 2021, MVS Ref No. P13401US00; and (D) Chinese application 202010622790.2, filed Jul. 1, 2020, and U.S. Ser. No. 17/249,299, filed Feb. 26, 2021, MVS Ref No. P13437US00.

FIELD OF THE INVENTION

The present disclosure relates to the technical field of locks, specially relates to an anti-unlatched mechanism and a door lock thereof.

BACKGROUND OF THE INVENTION

A multi-point lock with shootbolts is a lock capable of extending both upper and the lower shootbolts (i.e. the corresponding top lock and bottom lock) out of the door when being locked up. The multi-point lock with top lock and bottom lock works in the following principle: when opening a locked door, turn the lock cylinder with a key on the outside of the door or thumb drive or turn on the inside of the door to withdraw the deadbolt, and then press the lever handle down to withdraw the latch bolt and the upper and the lower shootbolts simultaneously, such that the door can be opened. After the lever handle is released, the latch bolt will extend, and the lever handle will return to its original position. When locking a closed door, raise the lever handle at a certain angle to extend the upper and the lower shootbolts, and then use a key or a thumb turn cylinder in the room to turn the cylinder to extend the deadbolt, thereby locking the door. After the lever handle is released, the lever handle will return to the original position. When the door is locked by the upper and the lower shootbolts, deadlatch and the latch bolt, the safety is well improved.

However, there is a unlatch phenomenon for the existing multi-point lock when extending the upper and lower shootbolts. That is, the shootbolts do not fully extend when the lever handle is raised, enabling the shootbolts to withdraw by only pressing down lever handle, which greatly reduce the safety of the door lock and degrade the user's experience.

SUMMARY OF THE INVENTION

In order to overcome the above-mentioned drawbacks of the prior art, an object of the present invention is to provide an anti-unlatched mechanism and a door lock thereof, which effectively assure a lock state of the upper and lower locking shootbolts when the door is in a locked state, thereby greatly improving the safety of the door lock and the user's experience.

The present invention adopts the following technical solution to solve its technical problem:

An anti-unlocked mechanism comprising a transmission gear, a sliding rod, a locking member and a first elastic member, all provided in the lock body;

The transmission gear is engaged with the rotating part in the lock body for driving the upper shootbolt and the lower shootbolt of the lock body to lock/unlock a door, wherein the rotating part is used for installing the lever handle. The outer peripheral surface of the transmission gear is comprised of a circular arc surface and a plurality of gear teeth, and a distance from the circular arc surface to the center of the rotation shaft of the transmission gear is greater than a distance from the tooth crest of the transmission gear to the center of the rotation shaft of the transmission gear;

The sliding rod is arranged in the lock body and may slide relative to the lock body, with an end of the sliding rod being in contact with the latch bolt of the lock body. The sliding rod is provided with a fixed stopper and a second elastic member. When the deadbolt is retracted, the sliding rod moves with the deadbolt against the elastic force of the second elastic member;

The locking member interacts with the sliding rod, and when the deadbolt extends, the locking member moves with the sliding rod to block the rotating movement of the rotating part.

The first elastic member comprises a first protrusion for contacting with the circular arc surface, and a second protrusion for contacting with the fixed stopper. The second protrusion will not hinder the fixed stopper to slide with the sliding rod unless the first protrusion is in contact with the circular arc surface, which will block the movement of the locking member to block the rotating movement of the rotating part.

As preferred, an oblique guide surface is provided at the contact point between the sliding rod and the bolt.

As preferred, the locking member comprises a first side part and a second side part connected at an angle and a positioning post on the connection of the first side part and the second side part, and the locking member in the lock body may swing via the positioning post.

As preferred, a pair of limiting posts are provided on the sliding rod, and a space is formed between the pair of the limiting posts;

The first side part is clamped by, or received between, the limiting posts in the space, enabling the locking member to swing as the sliding rod slides; the rotating part is fixed with a protruding block, and when the second elastic member is in a natural state, the second side part swings beneath the rotational path of the block and abuts against the block.

As preferred, when the second elastic member is in a natural state, the extension cord of the second side part is tangent to the rotational path of the block.

As preferred, the first protrusion and the second protrusion of the first elastic member protrude in opposite directions.

As preferred, the rotating part includes a body and a plurality of driving toothed pieces rotatably arranged relative to the body.

The body is provided with a mounting hole for installing lever handle, and a third elastic member is provided between the body and the lock body for restoring the body after it rotates.

The transmission gear is coaxially provided with a driven gear, and the driving toothed piece is engaged with the driven gear.

As preferred, the upper shootbolt is provided with a first rack at the end extending into the lock body, and the lower shootbolt is provided with a second rack at the end extending into the lock body, and a synchronous gear engaged with the first rack and the second rack is arranged therebetween;

The transmission gear is engaged to the first rack or the second rack.

As preferred, the body is provided with a mounting groove for mounting the third elastic member, a first opening, and a second opening staggered with the first opening, wherein both openings are in communication with the mounting groove.

The third elastic member extends with two ends across the first opening and the second opening, respectively and abut against both sides of the fixed structure of the lock body, respectively.

A door lock includes the anti-unlocked mechanism described above.

Compared with the prior art, the beneficial effects of the present invention are:

The solution includes a transmission gear, a first elastic member and a sliding rod, and the sliding rod is provided with a fixed stopper and a locking member interacts with the sliding rod, and a circular arc surface is arranged on the transmission gear, so that when the lock body is being locked, for example when the lever handle is raised, the rotating part drives the transmission gear to rotate, and the transmission gear drives the upper and lower shootbolts to extend and lock. During the locking process, as the deadbolt abutting against the sliding rod is in the extended state, the second elastic member will return to its natural state, driving the sliding rod to restore to a raised or natural position. If the locking is successfully performed at this moment, the locking member will move until it abuts against the rotating part, so that the lever handle will be prevented from being pressed down, thereby the user can be aware of the information that the lock is in place; if the shootbolts are not fully extended and the lock is unlatched at this time, the circular arc surface will be abutting against the first protrusion of the first elastic member, so that the second protrusion will be abutting against the fixed stopper to prevent the locking member from swinging to block the movement of the rotating part, allowing the lever handle to be pressed down, thereby the user realizes that the lock body is unlocked. In this situation, the lock body can be locked again by merely raising the lever handle to pass the first protrusion out of the contact with the circular arc surface. This invention provides a compact structure with ingenious design which determines whether a lock is in an unlock state effectively by mutual linkage between the parts, by which the unlock problem is also solved, and the entire operation is simple and convenient, which greatly improves the safety of the door lock and the user's experience.

BRIEF DESCRIPTION OF THE DRAWINGS

For better illustrating the technical solution of the embodiments of the present disclosure, the figures used for describing the embodiments will be briefly described below. Obviously, the figures described in the following are some embodiments of the present disclosure. For those skilled in the art, other figures can be obtained on the basis of these figures without any creative work.

Wherein:

1—lock body,
11—transmission gear,
111—circular arc surface,
12—sliding rod,
121—fixed stopper,
122—second elastic member,
123—guide surface,
124—limiting posts,
13—locking member,
131—first side part,
132—second side part,
133—positioning post,
14—first elastic member,
141—first protrusion,
142—second protrusion,
15—rotating part,
151—block,
152—body,
1521—mounting hole,
1522—mounting groove,
1523—first opening,
1524—second opening,
153—driving tooth,
16—upper shootbolt,
161—first rack,
17—lower shootbolt,
171—second rack,
18—deadbolt,
19—third elastic member,
20—synchronous gear.

DETAILED DESCRIPTION OF THE PREFERRED EMBODIMENTS

For better understanding of the above objects, features and advantages of the present invention, the present invention will be described in detail below with reference to the drawings and specific embodiments. It should be noted that the embodiments of the present invention and the features in the embodiments can be combined with each other without conflict. In the following description, many specific details are set forth in order to fully understand the present invention. The described embodiments are only a part of the embodiments of the present invention, but not all the embodiments. Based on the embodiments in the present invention, any other embodiments obtained by those skilled in the art, without making any creative work, will fall within the protection scope of the present invention.

All technical and scientific terms used herein have the same meaning as commonly understood by those skilled in the technical field of the present invention unless otherwise defined. The terminology used herein is for describing the specific embodiments, and is not intended to limit the present invention.

Example 1

Figure 1:
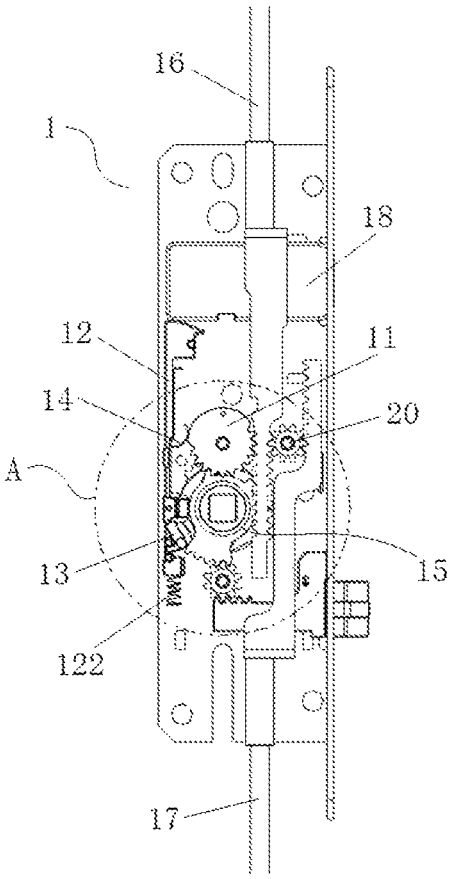
FIG. 1 is a side elevation view showing the internal structure of a door lock of the present invention in an unlocked state.
Figure 2:
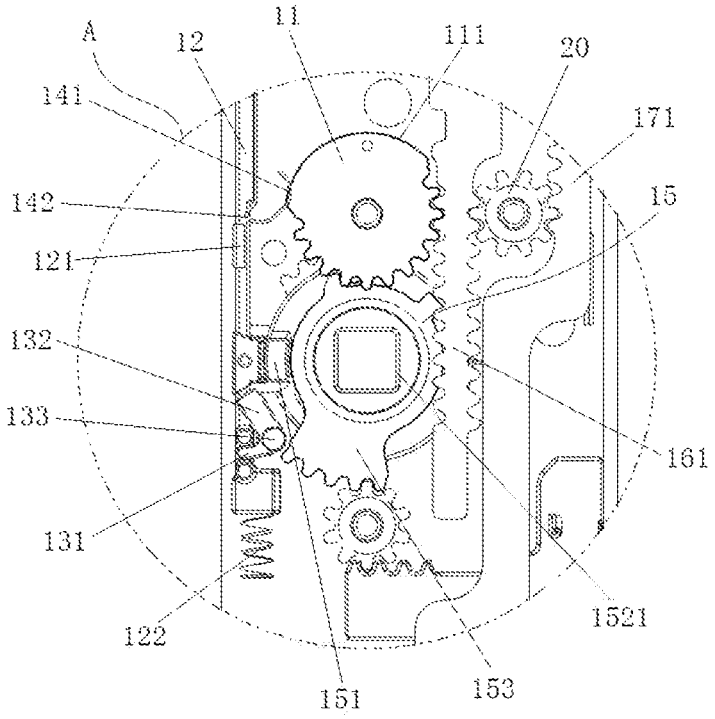
FIG. 2 is an enlarged view of structure in Circle A of FIG. 1.
Figure 3:
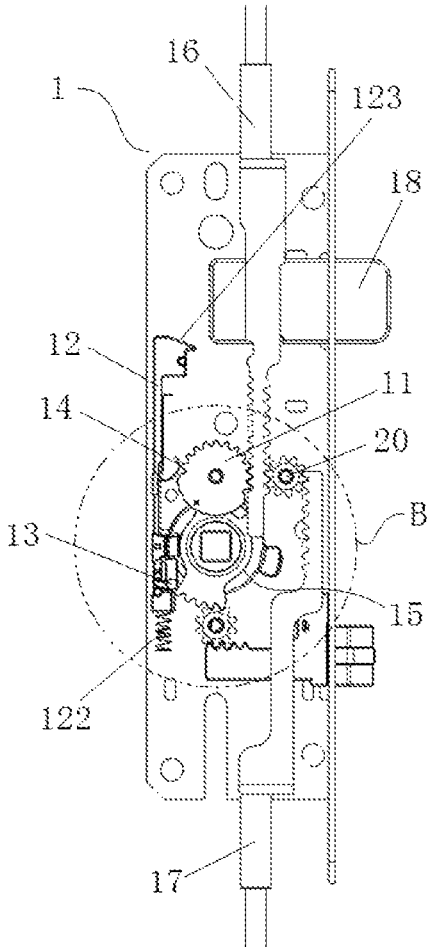
FIG. 3 is a side elevation view illustrating the internal structure of the present invention in a locked state.
Figure 4:
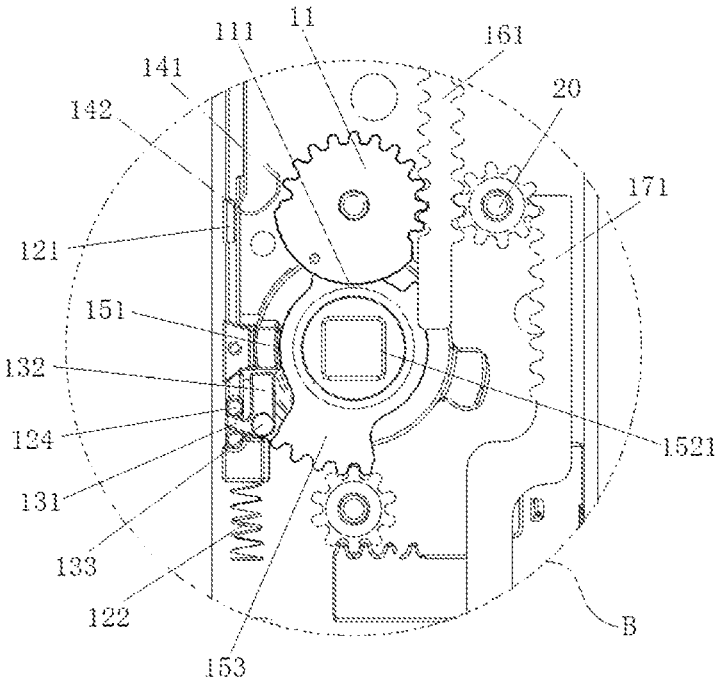
FIG. 4 is an enlarged view of structure in Circle B of FIG. 2.
Figure 5:
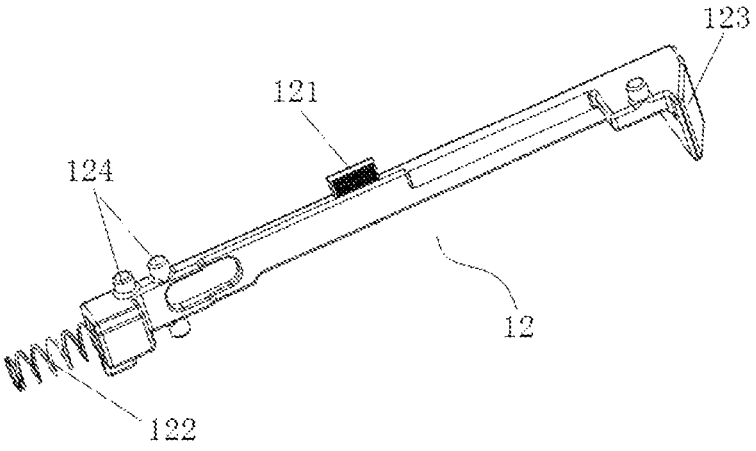
FIG. 5 is a perspective view of the sliding rod of the present invention.
Figure 6:
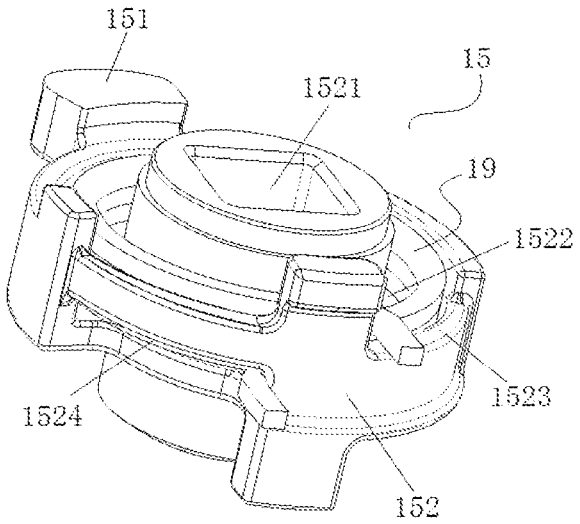
FIG. 6 is a perspective view of the rotating part of the present invention.
Figure 7:
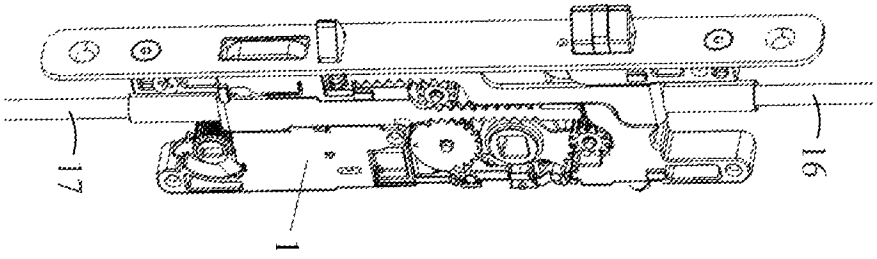
FIG. 7 is a perspective view illustrating the structure of the door lock according to the present invention.

As shown in FIGS. 1-7, this embodiment provides an anti-unlocked mechanism comprising a transmission gear 11, a sliding rod 12, a locking member 13 and a first elastic member 14, all provided in a lock body 1.

Specifically, the transmission gear 11 is engaged with the rotating part 15 in the lock body 1 for driving the upper shootbolt 16 and the lower shootbolt 17 of the lock body 1 to lock/unlock a door, and a lever handle is mounted on the rotating part 15. The outer peripheral surface of the transmission gear 11 is comprised of circular arc surface 111 and a plurality of gear teeth, and a distance from the circular arc surface 111 to the center of the rotation shaft of the transmission gear 11 is greater than a distance from the tooth crest of the transmission gear 11 to the center of the rotation shaft of the transmission gear 11, thereby enabling the circular arc surface 111 and the first elastic member 14 to be effectively contacted. In this embodiment, the arc length of the circular arc surface 111 is corresponds to the extension length or distance of the upper shootbolt 16 and the lower shootbolt 17 when being locked. The distance of the unlocked state is controlled by regulating or adjusting the arc length of the circular arc surface 111. In other words, the length of the arc surface 111 corresponds to or matches the distance the upper and lower shootbolts 16, 17 extend and retract between the locked and unlocked conditions.

The sliding rod 12 is arranged in the lock body 1 and may slide relative to the lock body 1. The upper end of the sliding rod 12 is in contact with the bolt 18 of the lock body 1 for pressing against the bolt 18. The sliding rod 12 is also provided with a fixed stopper 121 between the ends, and a second elastic member 122 at the lower end. When the bolt 18 is retracted, the sliding rod 12 is pushed downwardly by the bolt 18, against the elastic force of the second elastic member 122.

In this embodiment, the bolt 18 in contact with the sliding rod 12 is configured as a deadbolt One end of the sliding rod 12 is in contact with the deadbolt 18, and the other end of the sliding rod 12 is arranged with a second elastic member 122, wherein the second elastic member 122 is configured as a spring. Alternatively, the second elastic member 122 can also be configured at the end in contact with the deadbolt 18, in which case the second elastic member 122 is selected as a tension spring.

As a preferred solution, an oblique guide surface 123 is provided on the sliding rod 12 at the contact between the sliding rod 12 and the bolt 18. In this embodiment, the guide surface 123 is provided at the end of the sliding rod 12 for smoothly pressing down the sliding rod 12 when the bolt 18 is retracted. Alternatively, it is possible to provide the guide surface 123 on the bolt 18, rather than on the sliding rod 12.

The locking member 13 is engaged with the sliding rod 12, and when the bolt 18 extends, the second elastic member 122 will return to its natural state to slide the sliding rod 12, driving the locking member 13 to move until blocking the rotating movement of the rotating part 15, and thus block rotation of the handle connected to the rotating part 15.

As a preferred solution, the locking member 13 comprises a first side part 131 and a second side part 132 connected at an angle and a positioning post 133 on the connection of the first side part 131 and the second side part 132, thereby the locking member forms an L-shaped or a V-shaped configuration in a side view, and the locking member 13 in the lock body 1 may swing or rotate via the positioning post 133.

In addition, a pair of limiting posts 124 are provided on the sliding rod 12, and a space is formed between the pair of limiting posts 124. The first side part 131 is received or clamped between the limiting posts 124 in the space, enabling the locking member 13 to pivot as the sliding rod 12 slides. Specifically, the rotating part 15 is provided with an extending block 151, and when the second elastic member 122 is in a natural state, the locking member 13 moves upwardly with the sliding rod 12, so that the second side part 132 swings beneath the rotational path of the block 151 until abuts against the block 151 to block the rotation of the rotation portion 15. In this embodiment, the limiting posts 124 are each formed as a cylinder for coordinate movement between the sliding rod 12 and the locking member 13.

As a preferred solution, when the second elastic member 122 is in a natural state, the extension cord of the second side part 132 is tangent to the rotational path of the block 151. In case that the lever handle is pressed too hard, causing the locking member 13 rotate reversely to slide the sliding rod 12 to open the lock, which further improves the stop protection of the rotating part 15. Therefore, the reliability of the mechanism is further improved, and the life time of the parts are extended as mis-operation is avoided.

The first elastic member 14 comprises a first protrusion 141 for contacting with the circular arc surface 111, and a second protrusion 142 for contacting with the fixed stopper 121, wherein the first protrusion 141 and the second protrusion 142 protrude in opposite directions. The second protrusion 142 will not hinder the fixed stopper 121 to slide with the sliding rod 12, unless the first protrusion 141 is in contact with the circular arc surface 111, which will block the movement of the locking member 13 to block the rotating movement of the rotating part 15.

Further, the rotating part 15 includes a body 152 and a plurality of driving teeth 153 rotating relative to the body 152, and the block 151 is arranged on the body 152. The body 152 is provided with a mounting hole 1521 for installing a lever handle (not shown). In this embodiment, the cross section of the mounting hole 1521 is preferably configured in the form of a polygon. A third elastic member 19 is provided between the body 152 and the lock body 1 for restoring the body 152 after it rotates. The transmission gear 11 is coaxially provided with a driven gear, and one of the driving toothed pieces 153 is engaged with the driven gear.

As a preferred solution, the upper shootbolt 16 is provided with a first rack 161 at the end extending into the lock body 1, and the lower shootbolt 17 is provided with a second rack 171 at the end extending into the lock body 1, and a synchronous gear 20 engaged with the first rack 161 and the second rack 171 and is arranged therebetween. The transmission gear 11 is engaged to the first rack 161 or to the second rack 171.

In addition, the body 152 is provided with a mounting groove 1522 for mounting the third elastic member 19, a first opening 1523, and a second opening 1524 staggered with the first opening, wherein both openings are in communication with the mounting groove 1522. In this embodiment, the third elastic member 19 is a torsion spring. The third elastic member 19 extend with two ends across the first opening 1523 and the second opening 1524, respectively and abut against both sides of the fixed structure of the lock body 1, respectively.

In this embodiment, a door lock comprising the lock body 1 and the anti-unlocked mechanism described above is also provided.

For other structural forms of the door lock described in this embodiment, please refer to the prior art, which will not be repeated here.

The above is only the preferred embodiments of the present invention and does not limit the present invention in any form, so any modification, equivalent changes or replacements to the above embodiments, based on the technical essence of the present invention, without departing from the technical solution content of the present invention, are still within the scope of the technical solution of the present invention.

What is claimed is:

1. An anti-unlocked mechanism, comprising a transmission gear, a sliding rod, a locking member and a first elastic member, all provided in a lock body;

the transmission gear being engaged with a rotating part in the lock body for driving an upper shootbolt and a lower shootbolt of the lock body to lock/unlock a door, wherein the rotating part is used for installing a lever handle;

the outer peripheral surface of the transmission gear is comprised of a circular arc surface and a plurality of gear teeth, and a distance from the circular arc surface to the center of a rotation shaft of the transmission gear is greater than a distance from a tooth crest of the transmission gear to the center of the rotation shaft of the transmission gear;

the sliding rod sliding relative to the lock body, with an end of the sliding rod being in contact with a bolt of the lock body, the sliding rod having with a stopper and a second elastic member;

when the bolt is retracted, the sliding rod moves with the bolt against an elastic force of a second elastic member;

the locking member interacting with the sliding rod, and when the bolt extends, the locking member moves with the sliding rod to block rotating movement of the rotating part;

the first elastic member comprising a first protrusion for contacting with the circular arc surface, and a second protrusion for contacting with the fixed stopper;

the second protrusion not hindering the fixed stopper to slide with the sliding rod unless the first protrusion is in contact with the circular arc surface, which will block the movement of the locking member to block the rotating movement of the rotating part.

2. The anti-unlocked mechanism according to claim 1, wherein an oblique guide surface is provided at a contact point between the sliding rod and the bolt.

3. The anti-unlocked mechanism according to claim 1, wherein he locking member comprises a first side part and a second side part connected at an angle and a positioning post on the connection of the first side part and the second side part, and the locking member in the lock body may swing via the positioning post.

4. The anti-unlocked mechanism according to claim 3, wherein a pair of limiting posts are provided on the sliding rod, and a space is formed between the pair of the limiting posts to receive the first side part of the locking member the first side part is captured by the limiting posts in the space, enabling the locking member to swing as the sliding rod slides;

the rotating part has a block, and when the second elastic member is in a natural state, the second side part swings beneath the rotational path of the block and abuts against the block.

5. The anti-unlocked mechanism according to claim 4, wherein an extension cord of the second side part is tangent to a rotational path of the block when the second elastic member is in a natural state.

6. The anti-unlocked mechanism according to claim 1, wherein the first protrusion and the second protrusion protrude in opposite directions.

7. The anti-unlocked mechanism according to claim 1, wherein the rotating part includes a body and a plurality of driving toothed pieces rotatably arranged relative to the body;

the body is provided with a mounting hole for installing a lever handle, and a third elastic member is provided between the body and the lock body for restoring the body after it rotates;

the transmission gear is coaxially provided with a driven gear, and a driving toothed piece is engaged with the driven gear.

8. The anti-unlocked mechanism according to claim 1, wherein the upper shootbolt is provided with a first rack at the end extending into the lock body, and the lower shootbolt is provided with a second rack at the end extending into the lock body, and a synchronous gear engaged with the first rack and the second rack;

the transmission gear being engaged to the first rack or the second rack.

9. The anti-unlocked mechanism according to claim 7, wherein the body is provided with a mounting groove for mounting the third elastic member, a first opening, and a second opening staggered with the first opening, wherein both openings are in communication with the mounting groove;

the third elastic member extends with two ends across the first opening and the second opening, respectively, and abuts against both sides of the lock body.

10. A multi-point door lock, comprising a lock body with an extensible and retractable deadbolt;

upper and lower shootbolts mounted to the lock body and being movable between extended and retracted positions relative to the lock body;

first and second racks in the lock body to extend and retract the shootbolts;

a rotating part rotatably mounted in the lock body and being operatively connected to a lever handle;

a transmission gear rotatably mounted in the lock body and operatively connected to the rotating part and to the first and second racks to drive the racks to extend and retract the shootbolts upon rotation of the lever handle;

a slide rod in the lock body moveable between a raised position and a lowered position;

a locking member connected to the slide rod to move between a lock position blocking rotation of the rotating part and an unlock position allowing rotation of the rotating part; and the lock member pivoting between the lock and unlock positions as the slide rod slides between the raised and lowered positions, respectively.

11. The multi-point door lock of claim 10 further comprising a spring to bias the rotating member to a neutral position.

12. The multi-point door lock of claim 11 wherein the slide rod includes a spring to bias the slide rod toward the raised position.

13. The multi-point door lock of claim 12 wherein the slide rod moves to the raised position when the deadbolt is extended.

14. The multi-point door lock of claim 13 wherein the slide rod moves to the lowered position by the deadbolt when the deadbolt is retracted.

15. The multi-point door lock of claim 14 wherein the slide rod has a guide surface for engagement by the deadbolt.

16. The multi-point door lock of claim 10 wherein the transmission gear has a peripheral surface having a curved portion and a toothed portion.

17. The multi-point door lock of claim 16 further comprising an elastic member engageable with the curved portion of the transmission gear and engageable with the slide rod.

18. The multi-point door lock of claim 17 wherein a distance from the curved surface to a center of the transmission gear is greater than a distance from a tooth crest of the transmission gear to the center of the transmission gear.

19. The multi-point door lock of claim 10 wherein the rotating part has a block which engages the locking member when the locking member is in the lock position to preclude rotation of the rotating part.

20. A multi-point door lock, comprising a lock body with an extensible and retractable deadbolt;

upper and lower shootbolts mounted to the lock body and being movable between extended and retracted positions relative to the lock body;

first and second racks in the lock body to extend and retract the shootbolts;

a rotating part rotatably mounted in the lock body and being operatively connected to a lever handle;

a transmission gear rotatably mounted in the lock body and operatively connected to the rotating part and to the first and second racks to drive the racks to extend and retract the shootbolts upon rotation of the lever handle;

a slide rod in the lock body moveable between a raised position and a lowered position;

a locking member connected to the slide rod to move between a lock position blocking rotation of the rotating part and an unlock position allowing rotation of the rotating part;

the transmission gear has a peripheral surface having a curved portion and a toothed portion; and an elastic member engageable with the curved portion of the transmission gear and engageable with the slide rod.

21. The multi-point door lock of claim 20 wherein a distance from the curved surface to a center of the transmission gear is greater than a distance from a tooth crest of the transmission gear to the center of the transmission gear.

22. The multi-point door lock of claim 20 wherein the rotating part has a block which engages the locking member when the locking member is in the lock position to preclude rotation of the rotating part.

* * * * *